US007232509B2

(12) United States Patent
Nara et al.

(10) Patent No.: US 7,232,509 B2
(45) Date of Patent: Jun. 19, 2007

(54) HYDROGEN EVOLVING CATHODE

(75) Inventors: Miwako Nara, Fujisawa (JP); Yoshinori Nishiki, Fujisawa (JP); Tsuneto Furuta, Fujisawa (JP)

(73) Assignee: Permelec Electrode Ltd., Kanagawa (JP)

( * ) Notice: Subject to any disclaimer, the term of this patent is extended or adjusted under 35 U.S.C. 154(b) by 0 days.

(21) Appl. No.: 11/224,081

(22) Filed: Sep. 13, 2005

(65) Prior Publication Data

US 2006/0070874 A1 Apr. 6, 2006

(30) Foreign Application Priority Data

Oct. 1, 2004 (JP) ..... P. 2004-289699

(51) Int. Cl.
*C25B 11/08* (2006.01)
*C25B 11/06* (2006.01)

(52) U.S. Cl. ..... 204/290.14; 204/290.12; 204/291; 204/292; 205/630; 205/631; 205/638; 205/639

(58) Field of Classification Search ..... 205/630, 205/631, 638, 639; 204/290.14, 293, 290.12, 204/290.01, 252, 291, 292
See application file for complete search history.

(56) References Cited

U.S. PATENT DOCUMENTS 6,194,338 B1 * 2/2001 Andolfatto et al. ..... 502/101
6,312,571 B1 * 11/2001 Nara et al. ..... 204/252

* cited by examiner

*Primary Examiner*—Bruce F. Bell
(74) *Attorney, Agent, or Firm*—Sughrue Mion, PLLC

(57) ABSTRACT

Highly active hydrogen evolving cathode using a platinum group metal catalyst in an amount smaller than that used in the conventional hydrogen evolving cathode. The hydrogen evolving cathode includes a conductive substrate, and a catalyst layer comprising at least one selected from the group consisting of silver and a silver oxide compound, and at least one selected from the group consisting of a platinum group metal, a platinum group metal oxide and a platinum group metal hydroxide, formed on a surface of the conductive substrate.

3 Claims, 1 Drawing Sheet

FIGURE
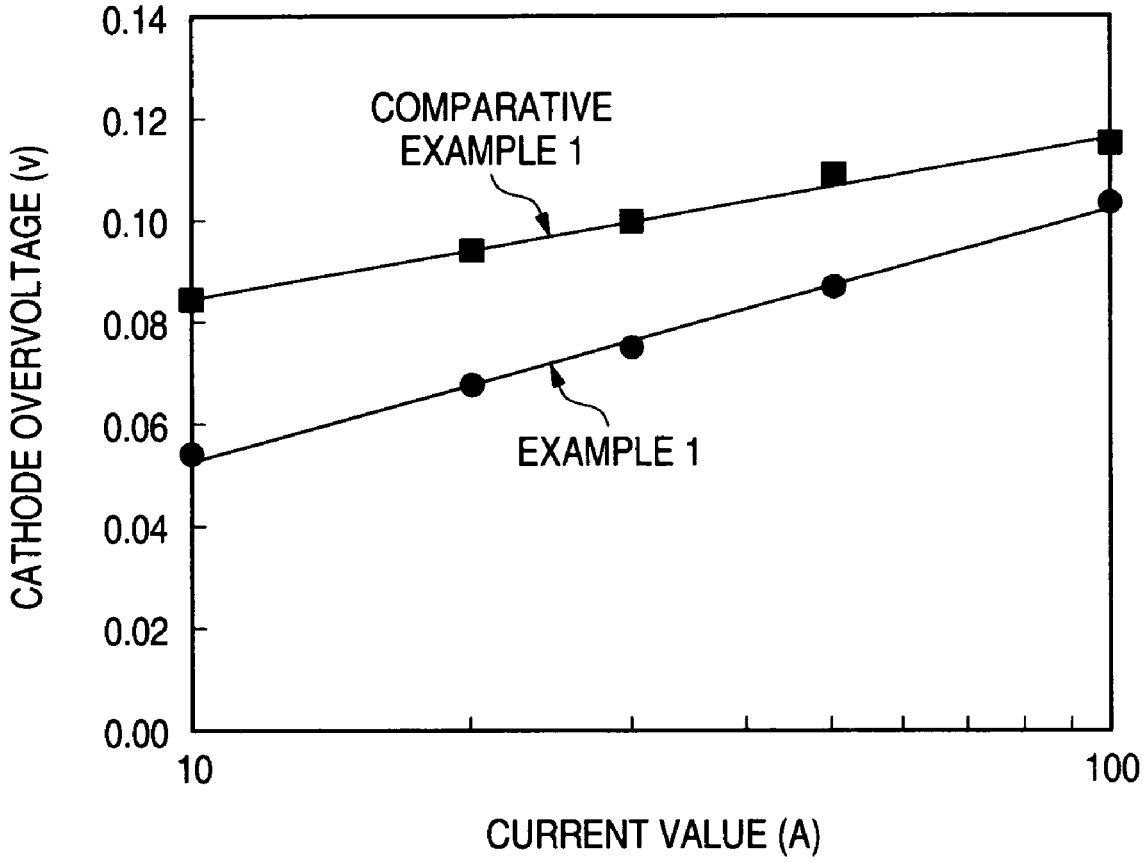

HYDROGEN EVOLVING CATHODE

FIELD OF THE INVENTION

The present invention relates to a hydrogen evolving cathode for use in industrial electrolysis. More specifically, the present invention relates to a hydrogen evolving cathode, particularly a cathode for hydrogen evolution, that can be produced inexpensively and enables electrolysis to conduct in a stable manner.

BACKGROUND ART

Sodium hydroxide and chlorine that are important as industrial starting materials are mainly produced by an electrolytic soda process. This electrolysis process shifted to an ion-exchange membrane process using an activated cathode involving small overvoltage through a mercury method using a mercury cathode and a diaphragm process using an asbestos diaphragm and a soft iron cathode. This shift decreased power unit for production of 1 ton of sodium hydroxide to 2,000 kWh. The activated cathode includes a cathode obtained by dispersing ruthenium oxide powder in a nickel plating bath and undergoing composite plating, and cathodes obtained by using nickel plating containing a second component such as S or Sn, NiO plasma spray coating, Raney nickel, Ni—Mo alloy, Pt—Ru substituted plating, or a hydrogen storage alloy for imparting durability to reverse current (*Electrochemical Hydrogen Technologies*, p. 15–62, 1990, H. Wendt; U.S. Pat. No. 4,801,368; *J. Electrochem. Soc.*, 137, 1419 (1993); and *Modern Chlor-Alkali Technology*, Vol. 3, 1986). JP-B-6-33481 and JP-B-6-33492 teach that a mixed catalyst of cerium and a noble metal is durable to contamination with iron. Recently, an electrolytic cell that can increase current density for the purpose of increasing production ability and decreasing an investment cost is now under development in an ion-exchange membrane process. Development of a low resistance membrane enables large current to apply.

DSA which is an anode has operating results in a current density up to 200–300 A/dm$^2$ in a mercury method. However, there are no actual results in such DSA regarding life and performance when used as a cathode in an ion-exchange membrane process, and further improvement is demanded. It is important for use as a cathode to be low overvoltage, to be a membrane not impaired by contacting with a cathode, and to be low contamination with, for example, metal ions from a cathode. Thus, this makes it difficult to use the conventional electrodes (having large surface unevenness and low mechanical strength of a catalyst layer). To realize a new process, it is indispensable to develop an activated cathode having high performance and also sufficient safety even under the above electrolysis conditions.

In the recent electrolytic soda process using an activated cathode most generally conducted, a cathode is arranged so as to contact with a cathode side of a cation-exchange membrane, or to have a gap of 3 mm or lower from an ion-exchange membrane. Water reacts in a catalyst layer of the cathode to form sodium hydroxide. Anodic reaction and cathodic reaction are as follows, respectively.

$$2Cl^- = Cl_2 + 2e \ (1.36V)$$

$$2H_2O = 2OH^- + H_2 \ (-0.83V)$$

Theoretical decomposition voltage is 2.19V

However, where the conventional cathode is operated at a large current density, there are some large problems, for example, as follows.

(1) Part of a substrate (nickel, iron or carbon component) dissolves and peels due to deterioration of an electrode, and such a component migrates into a catholyte, a membrane or an anode chamber, resulting in deterioration of product quality and deterioration of electrolysis performance.

(2) Overvoltage increases with increasing a current density, resulting in decreasing energy efficiency.

(3) Distribution of gas bubbles in a cell increases with increasing a current density, resulting in causing distribution in concentration of sodium hydroxide formed. As a result, solution resistance loss of a catholyte increases.

(4) Where operating conditions are severe, an amount of impurities (sulfur, iron or the like) effused from a cell constituting material increases, resulting in contamination of an electrode.

It is expected that a constitution that a cathode is arranged so as to closely contact with an ion-exchange membrane (zero gap) can decrease voltage, and such a constitution is desirable. However, this constitution has the possibility that a membrane is mechanically broken by a cathode having a rough surface. Thus, there has been the problem to use the conventional cathode at high current density and under zero gap condition. A cathode using a noble metal as a catalyst has conventionally been proposed. Such a cathode may be satisfactory in performance. However, there is the problem in cost, and it is essential to decrease the amount of the catalyst used. In this case, thickness of the catalyst layer is small, so that a substrate is liable to peel by dissolution. Thus, further improvement is still required.

SUMMARY OF THE INVENTION

Accordingly, an object of the present invention is to provide an hydrogen evolving cathode (cathode for hydrogen evolution) that can overcome the problems in the prior art, can be used in electrolysis at large current density even in zero gap arrangement, uses an expensive noble metal in minimum amount to decrease cost, and is difficult to cause peeling or the like.

The hydrogen evolving cathode according to the present invention comprises a conductive substrate, and a catalyst layer comprising at least one selected from the group consisting of silver and a silver oxide compound, and at least one selected from the group consisting of a platinum group metal, a platinum group metal oxide and a platinum group metal hydroxide, formed on a surface of the conductive substrate.

The hydrogen evolving cathode preferably further comprises an interlayer comprising a conductive oxide between the conductive substrate and the catalyst layer.

BREIF DESCRIPTION OF THE DRAWING

The FIGURE is a graph showing the relationship between current value and cathode overvoltage in the hydrogen evolving cathodes obtained in Example 1 and Comparative Example 1.

DETAILED DESCRIPTION OF THE INVENTION

The present invention is described in detail below.

The hydrogen evolving cathode according to the present invention comprises a conductive substrate having formed on the surface thereof a catalyst layer directly or through an interlayer, wherein the catalyst layer comprises silver or a silver compound, and a platinum group metal or its compound.

Thus, the catalyst layer used in the present invention comprises silver or a silver compound, and a platinum group metal or its compound. The molar ratio of the metal silver to the platinum group metal is generally (1–200):1, preferably about 50:1. It can be presumed in the catalyst layer constituted of such a molar ratio to have a form that fine particles of the platinum metal or its compound are deposited to the outer surface of bulky silver or silver oxide particles and are highly dispersed in the inside thereof. It is confirmed that due to platinum fine particles being highly dispersed, effective electrolysis area of the platinum group metal compound increases, thereby showing good electrolysis properties even with a small amount of the platinum group metal compound.

When the cathode is made to have a smooth surface having a roughness of 0.01 mm or smaller, possibility of damage is further decreased.

Thus, the cathode for hydrogen evolution is obtained by applying to the conductive substrate the catalyst layer wherein platinum or platinum group metal compound functioning as main catalyst components is highly dispersed utilizing silver particles. Such a cathode can minimize the amount of expensive platinum or platinum group metal compound used, resulting in decrease in production cost.

It is believed that the catalyst layer forms a porous structure as a whole. Therefore, it is presumed that where the catalyst layer is directly applied to the surface of the conductive substrate, a catholyte permeates into the substrate when used as a cathode, thereby accelerating consumption of the substrate. For this reason, when a porous catalyst layer is used, it is essential to provide an interlayer.

When the catalyst layer is applied to the conductive substrate through the interlayer, impurities effused from cell constituting materials are prevented from contacting with the conductive substrate, and the cathode has a stable performance to contamination with such impurities. As a result, it is possible to conduct electrolysis in a stable manner using an inexpensive cathode.

Thus, addition of silver and/or silver compound to the cathode comprising platinum group metal or its compound as the main catalyst substance has the effects to increase dispersibility of platinum group metal catalyst particles, and prevent the cathode from being poisoned with catalyst metal by electrolysis. Due to the effects, overvoltage can be decreased even in a smaller amount of a catalyst than the conventional, the cathode does not damage a membrane by the contact of the same with the membrane, and loss of the catalyst is small even in the use for a long period of time. Thus, the cathode has a large industrial value. Further, because the membrane is difficult to be damaged as described above, the amount of the expensive catalyst used can be minimized, making it possible to decrease investment and electric power costs.

The present invention is further described by the following practical embodiments of the hydrogen evolving cathode, but it should be understood that the invention is not construed as being limited thereto.

The cathode substrate used preferably comprises stainless steel, titanium, nickel or a carbonaceous material. The substrate has a thickness of preferably 0.05–5 nm, and a porosity of preferably 10–95%.

The substrate is described with reference to nickel which is a preferable material. The nickel substrate is preferably subjected to surface roughening treatment in order to increase adhesion between the substrate and the catalyst layer or the interlayer. Examples of the surface roughening method include conventional methods such as a blast treatment spraying powder, an etching method using soluble acid, and a plasma spray coating method. Chemical etching treatment is further applied to the roughened surface to remove contaminant particles such as metals or organic materials, remaining on the surface. The amount of nickel substrate consumed after the surface roughening treatment is preferably 50–500 g/m$^2$.

In the present invention, the catalyst layer may directly be formed on the surface of the nickel substrate, but the interlayer comprising a conductive oxide is preferably formed between the nickel substrate and the catalyst layer. The interlayer preferably comprises the same material as the substrate, viz., an oxide of nickel in this practical embodiment. However, the material of the interlayer is not limited to this.

The interlayer can be formed by merely subjecting the nickel substrate to heat treatment, thereby reacting nickel with oxygen in air to form $Ni_{(1-x)}O$. The heat treatment temperature is preferably 350–550° C., and the heat treatment time (baking time) is preferably 5–60 minutes. Oxides formed generally have oxygen defect, although depending on the production conditions, and therefore generally have p-type semiconductivity. Where thickness of the oxide is too large, resistance loss increases, and on the other hand, where it is too small, only heterogeneous surface layer (interlayer) is obtained. Optimum thickness is about 0.1–100 μm. The interlayer is preferably formed on the surface of the substrate uniformly such that metal of the substrate does not contact with an alkaline aqueous solution which is an electrolytic solution.

Other than the formation of the interlayer by merely heat treating the substrate, the interlayer can be formed by applying a solution containing nickel to the substrate or dipping the substrate in the coating solution, and then heat treating the thus treated substrate in the same manner as above. When this formation method is employed, a solution having a composition which erodes the substrate is preferably used. The starting nickel is, for example, nickel nitrate or nickel sulfate. The starting nickel is added to nitric acid or sulfuric acid, and the resulting aqueous solution after adjusting to a suitable concentration can be used as a coating solution. After coating or dipping, and then drying, thermal decomposition is conducted.

As described above, even when the substrate comprises nickel, a conductive oxide interlayer comprising other component can be formed. An oxide that is stable to an alkali, and has hydrogen evolution ability extremely smaller than that of the catalyst on the surface of the substrate, which therefore can be disregarded, for example, n-type titanium oxide ($TiO_{2-x}$), can be used. The interlayer can be formed in the similar manner as described above using a coating solution of the corresponding compound.

The interlayer may comprises a laminate of two catalyst layers having a different molar ratio of platinum and silver. In this two layered interlayer, it is desirable that a platinum rich layer is provided at the side of the catalyst layer, and a silver rich layer is provided at the side of the substrate. The ratio of platinum: silver in this case is preferably 1:(5–50) (molar ratio) in the layer at the catalyst layer side, 1:(50–1, 200) molar ratio in the layer at the substrate side, and 1:(1–200) (molar ratio) in the combined layer.

The catalyst layer comprises at least one selected from the group consisting of silver and a silver oxide compound, and at least one selected from the group consisting of a platinum group metal, a platinum group metal oxide and a platinum group metal hydroxide, and is formed as a metal layer, an oxide mixed layer, a hydroxide mixed layer, or an alloy layer. The catalyst layer has a form that platinum group metal compound fine particles are deposited to the outer surface of bulky silver or silver oxide particles and are highly dispersed in the inside thereof It was confirmed that due to platinum fine particles being highly dispersed, effective electrolysis area of the platinum group metal compound increases, thereby showing good electrolysis properties even with a small amount of the platinum group metal compound.

The catalyst used is a platinum group metal such as platinum, palladium, ruthenium or iridium, or its oxide or hydroxide. The catalyst layer is preferably formed such that similar to an anode (DSE) generally used in a brine electrolysis, a solution of a salt of the catalyst metal is applied to a substrate surface, and baked. However, the catalyst layer may be formed by preparing a salt solution, and conducting electroplating using the salt solution, or conducting electroless plating using a reducing agent. In particular, when the catalyst layer is formed by baking, a solution containing catalyst ions reacts with a nickel substrate, nickel substrate component permeates into the catalyst layer to dissolve as an oxide or a hydroxide, and this may adversely affect the membrane or the anode. However, the presence of the interlayer can prevent this corrosion.

Examples of the material for silver contained in the catalyst layer include silver oxide, silver nitrate and silver carbonate. This material is added to nitric acid, hydrochloric acid or water, and such an aqueous solution having the material dissolved in an appropriate concentration can be used as a coating solution. When platinum is used in the catalyst layer, hydrogen hexachloroplatinate, diamminedinitroplatinum or the like can be used as a material for platinum. The material is added to nitric acid, hydrochloric acid or water, and such an aqueous solution having the material dissolved in an appropriate concentration can be used as a coating solution. The ratio of platinum to silver is preferably 1:(1–200) (molar ratio).

The coating solution is applied to the substrate or the substrate is dipped in the coating solution. The substrate thus treated is dried at 40–150° C. for 5–20 minutes, and then subjected to heat decomposition reaction. The heat decomposition temperature is preferably 200–550° C., and the baking time is preferably 5–60 minutes. The total amount of the catalyst is preferably about 2–100 g/m$^2$, and the thickness of the catalyst layer is preferably about 0.1–20 μm.

When the cathode of the present invention is used in a brine electrolysis, a perfluorinated membrane is preferably used as an ion-exchange membrane from the standpoint of corrosion resistance. An anode used in the electrolysis is a titanium-based insoluble electrode containing a noble metal oxide, called DSE (Dimensionally Stable Electrode) or DSA (Dimensionally Stable Anode). The anode is preferably porous so as to use the same with close contact with a membrane. Where the cathode of the present invention is required to closely contact with a membrane, the cathode and the membrane are previously mechanically bound, or pressure is applied in conducting electrolysis. The pressure applied is preferably 0.1–30 kgf/cm$^2$. Electrolysis conditions are preferably that the temperature is 60–90° C., and current density is 10–100 A/dm$^2$.

The present invention is described in more detail by reference to the following Examples, but it should be understood that the invention is not construed as being limited thereto.

EXAMPLE 1

An electrolytic cell having an electrolysis area of 100 cm$^2$ (width: 5 cm, height: 20 cm) was used. Nickel mesh (8 mm long width, 6 mm short width, 1 mm thickness) was used as a cathode substrate. Surface of the substrate was roughened with alumina particles (#60), and then etched with 20 wt % boiling hydrochloric acid. The substrate thus treated was placed in a 500° C. furnace of air atmosphere to form nickel oxide on the surface thereof.

Using silver nitrate and diamminedinitroplatinum as raw materials, a coating solution having a total metal concentration of 1 wt % (silver:platinum=50:1 (molar ratio)) was prepared. The nickel mesh was dipped in the coating solution, and gradually taken out of the coating solution. The nickel mesh was dried at 60° C., and then baked in an electric furnace at 500° C. for 10 minutes. This treatment was repeated three times to make the final total catalyst amount to 100 g/m$^2$. The respective cathodes having the changed total catalyst amount of 2–100 g/m$^2$ were prepared by changing the repeating number of the treatment.

An electrolytic cell was fabricated, wherein DSE porous anode made of titanium was used as an anode, Nafion 981 (a product of Du Pont) was used as an ion-exchange membrane, the cathode and a porous member (current collector) were closely contacted with one side of the membrane, and the anode and a porous member (current collector) were closely contacted with other side of the membrane (current collector/cathode/membrane/anode/current collector). A saturated sodium chloride aqueous solution was supplied as an anolyte at a rate of 4 ml/min, and pure water was supplied to the cathode at a rate of 0.4 ml/min. In the cathode wherein the temperature was set to 90° C. and the total catalyst amount was 50 g/m$^2$, the cathode overvoltage when changing current value is shown in the attached FIGURE.

In the cell with the cathode having the total catalyst amount of 100 g/m$^2$, cell voltage at 50 A was 3.30V, and 33% NaOH was obtained from a cathode outlet with a current efficiency of 95%. After electrolysis for 10 days while stopping the electrolysis for one day in one week, the cell voltage increased 10 mV, but the current efficiency was maintained at 97%.

EXAMPLE 2

The same type of the cathode substrate as used in Example 1 was used. A solution containing tetrabutyl titanate in a concentration of 5 wt % was applied to the substrate at a coating coverage of 5 g/m$^2$. The substrate was placed in a 500° C. furnace of air atmosphere for 20 minutes to form a titanium oxide on the surface thereof.

Using hydrogen hexachloroplatinate and silver oxide as raw materials, a coating solution having a total metal concentration of 25 wt % (platinum:silver=1:9 (molar ratio)) was prepared. The nickel mesh was dipped in the coating solution, and gradually taken out of the coating solution. The nickel mesh was dried at 120° C., and then baked in an electric furnace at 550° C. for 15 minutes. This treatment was repeated five times to make the final total catalyst amount to 80 g/m$^2$.

An electrolytic cell was fabricated in the same manner as in Example 1, and the temperature was set to 90° C.

When 50 A current was applied, a cell voltage was 3.35V, and 33% NaOH was obtained from a cathode outlet with a current efficiency of 97%. After electrolysis for 10 days while stopping the electrolysis for one day in one week, the cell voltage increased 15 mV, but the current efficiency was maintained at 97%.

EXAMPLE 3

The same type of the cathode substrate as used in Example 1 was used. The substrate was placed in a 500° C. furnace of air atmosphere for 20 minutes to form a nickel oxide on the surface thereof Using silver nitrate and diamminedinitroplatinum as raw materials, a coating solution A having a total metal concentration of 0.5 wt % (silver: platinum=8:1 (molar ratio)) and a coating solution B having a total metal concentration of 0.5 wt % (silver:platinum=360:1 (molar ratio)) were prepared. The nickel mesh was dipped in the coating solution A, and gradually taken out of the coating solution A. The nickel mesh was dried at 60° C., and then baked in an electric furnace at 500° C. for 10 minutes. This treatment was repeated four times. The nickel mesh thus treated was further dipped in the in coating solution B, and gradually taken out of the coating solution B. The nickel mesh was dried at 60° C., and then baked in an electric furnace at 500° C. for 10 minutes. This treatment was repeated four times. The final total catalyst amount was 2 g/m$^2$.

An electrolytic cell was fabricated in the same manner as in Example 1, and the temperature was set to 90° C.

When 50 A current was passed, a cell voltage was 3.30V, and 33% NaOH was obtained from a cathode outlet with a current efficiency of 95%. After electrolysis for 10 days while stopping the electrolysis for one day in one week, the cell voltage increased 15 mV, but the current efficiency was maintained at 95%.

COMPARATIVE EXAMPLE 1

An electrode was prepared in the same manner as in Example 1, except that the catalyst layer was made of platinum alone, and was subjected to electrolysis in the same manner as in Example 1.

Cathode overvoltage when the current value was changed between 10 A and 100 A in a cathode wherein the entire catalyst amount is 50 g/m$^2$ is shown in the attached FIGURE.

It is apparent that when comparing the cathode overvoltage measured in Example 1 and Comparative Example 1 on the same catalyst amount, the overvoltage in Example 1 is 0.02–0.05V lower than that of Comparative Example 1 in all of the catalyst amounts, and good electrolysis performance is obtained in Example 1. It is further apparent that when comparing the cathode overvoltage measured in Example 1 and Comparative Example 1 on the same current value, the overvoltage in Example 1 is 0.01–0.02V lower than that of Comparative Example 1 in all of the current values, and good electrolysis performance is obtained in Example 1.

COMPARATIVE EXAMPLE 2

An electrode was prepared in the same manner as in Example 1, except that the catalyst layer was made of silver alone, and was subjected to electrolysis in the same manner as in Example 1. As a result, the initial overvoltage was 4.50V.

It should further be apparent to those skilled in the art that various changes in form and detail of the invention as shown and described above may be made. It is intended that such changes be included within the spirit and scope of the claims appended hereto.

This application is based on Japanese Patent Application No. 2004-289699 filed Oct. 1, 2004, the disclosure of which is incorporated herein by reference in its entirety.

What is claimed is:

1. A hydrogen evolving cathode comprising a conductive substrate, a catalyst layer, and an interlayer between the conductive substrate and the catalyst layer, wherein the interlayer comprises a conductive oxide and the catalyst layer comprises at least one selected from the group consisting of silver and a silver oxide compound, and at least one selected from the group consisting of a platinum group metal, a platinum group metal oxide and a platinum group metal hydroxide, and wherein a molar ratio of the at least one selected from the group consisting of silver and a silver oxide compound to the at least one selected from the group consisting of a platinum group metal, a platinum group metal oxide and a platinum group metal hydroxide is (50–200):1.

2. The hydrogen evolving cathode as claimed in claim 1, wherein the at least one selected from the group consisting of a platinum group metal, a platinum group metal oxide and a platinum group metal hydroxide is platinum.

3. The hydrogen evolving cathode as claimed in claim 1, wherein the conductive oxide is an oxide comprising at least one selected from the group consisting of nickel and titanium.

* * * * *